United States Patent [19]

Matthes et al.

[11] 4,456,899

[45] Jun. 26, 1984

[54] DEVICE AND METHOD FOR UTILIZATION OF HEAT DUE TO LOSSES IN TRANSFORMERS OR CHOKE COILS WHICH ARE INTERNALLY COOLED BY A LIQUID

[75] Inventors: Wolfgang Matthes, Waiblingen-Neustadt; Heinz Ubl, Stuttgart, both of Fed. Rep. of Germany

[73] Assignee: Transformatoren Union AG, Stuttgart, Fed. Rep. of Germany

[21] Appl. No.: 279,528

[22] Filed: Jul. 1, 1981

[30] Foreign Application Priority Data

Jul. 7, 1980 [DE] Fed. Rep. of Germany ..... 3025661

[51] Int. Cl.[3] ..... H01F 27/08

[52] U.S. Cl. ..... 336/55; 336/58; 336/61

[58] Field of Search ..... 336/55, 57, 58, 61; 174/14 R, 15 R

[56] References Cited

FOREIGN PATENT DOCUMENTS 8829 1/1979 Japan ..... 336/55

*Primary Examiner*—J. V. Truhe

*Assistant Examiner*—Susan Steward

*Attorney, Agent, or Firm*—Herbert L. Lerner; Laurence A. Greenberg

[57] ABSTRACT

Method and device of utilizing, through heat exchanger or heat pump provided in addition to a normal cooling system, heat due to energy loss in a coil device, such as a transformer or a choke coil having a liquid-cooled interior, which includes throttling the normal cooling system so as to set a difference between the temperature of the interior liquid coolant, at a location under a casing cover of the coil device, and a maximum permissible temperature for a normal useful life of insulation for the coil winding so that the temperature of the inner coolant is lower when the coil device is under full load than when it is under partial load.

10 Claims, 1 Drawing Figure

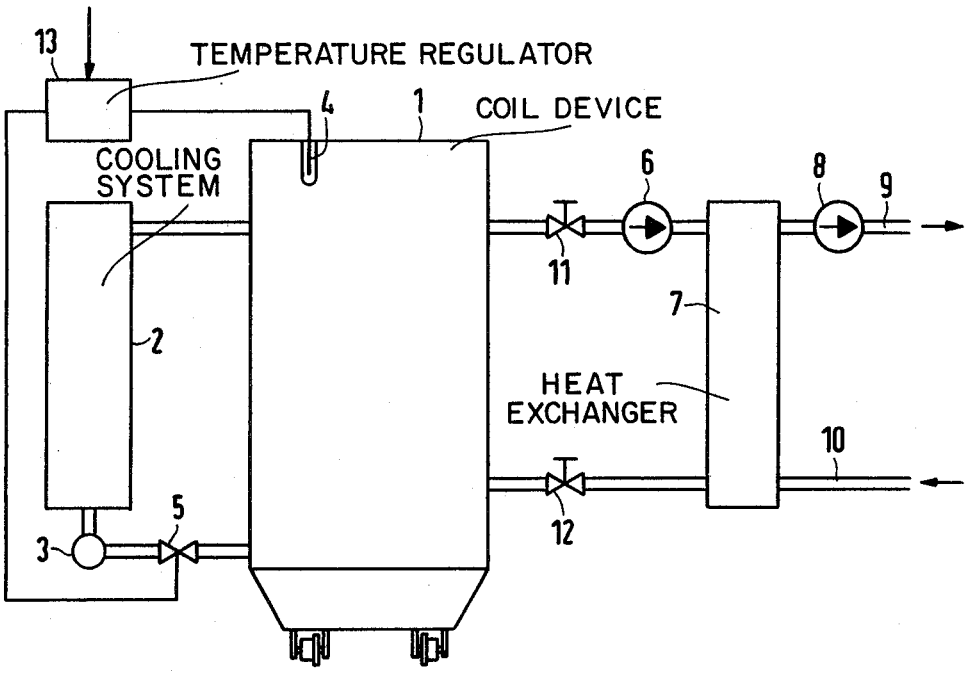
13
TEMPERATURE REGULATOR
4
1
COIL DEVICE
COOLING SYSTEM
6
8
9
11
7
2
HEAT EXCHANGER
10
5
3
12

DEVICE AND METHOD FOR UTILIZATION OF HEAT DUE TO LOSSES IN TRANSFORMERS OR CHOKE COILS WHICH ARE INTERNALLY COOLED BY A LIQUID

The invention relates to a device and method for utilization of heat due to energy loss in liquid-cooled transformers or choke coils wherein, by means of throttling the cooling system, the temperatures are maintained at a level which is not higher than respective maximum permissible temperatures with respect to normal useful life of the insulation of the windings.

Mainly for lack of economic justification, the heat due to energy loss in transformers or choke coils has generally not been utilized heretofore.

Normally, a transformer or a choke coil is not operated at full load all the time, but rather, operates at partial load most of the time. The heat thus generated at partial load is obviously less than at full load. Furthermore, the need to utilize heat due to energy loss for heating purposes exists only in the cold season of the year, during which the internal coolant oil of an externally air-cooled transformer remains colder anyway than at maximum ambient or surrounding temperature. Under the foregoing conditions, a relatively low temperature level which fluctuates rather sharply is established. Such a temperature level demands relatively great technical outlay in order to utilize the heat due to energy losses.

This low temperature level is caused by the long-term behavior of the insulating materials which are used in the transformer and which are not allowed to be thermally stressed too highly. Furthermore, the amount of energy due to losses in transformers is relatively small due to the high state of development thereof.

Technical possibilities relating to the utilization of the heat due to energy losses in transformers by means of heat pumps and heat exchangers are described in the periodical "Elektrizitätswirtschaft" in the 55th annual or publication year on pages 825 to 831 thereof. The solutions described therein start from the utilization of heat due to energy losses in oil transformers at low and average loads due to measures taken at the external cooling system therefor without thereby limiting the temperatures of the oil. In accordance with the conceptions provided thereat, the oil temperature which rises with increase of heat due to energy loss is limited only after reaching an adjustable maximum value, by the fact that normal self-cooling of the transformer is automatically set in operation. A disadvantage with respect to the utilization of heat due to energy losses is that, thereby, actually a smaller amount of heat due to energy loss results during partial-load operation at lower coolant temperatures than the amount of heat due to energy loss occurring during full load operation.

It is accordingly an object of the invention to provide such a device and method of utilizing heat due to energy loss in a coil device having an improved efficiency and economy. This is effected by raising the operating temperature of the internal coolant with respect to varying load conditions, to such an extent that, no increased thermally-caused reduction in the operational life of the winding-insulation of the coil device occurs when there is no utilization of heat due to energy loss. In this regard consideration must be given so the fact that the maximum thermal stress at the winding insulation is determined by the hot point temperature of the conductor of the winding.

With the foregoing and other objects in view, there is provided, in accordance with the invention, a method of utilizing, through heat exchanger or heat pump provided in addition to a normal cooling system, heat due to energy loss in a coil device such as a transformer or a choke coil having an interior containing an insulated coil winding cooled by a liquid cooling system which comprises throttling the normal cooling system in accordance with an adjusted difference between the temperature of the interior liquid coolant taken at a location under a casing cover of the coil device, and a maximum permissible temperature for a normal useful life of the coil-winding insulation and so that the temperature of the inner coolant is lower when the coil device is under full load than when it is under partial load.

In accordance with advantageous embodiments of the device of the invention, provision is made for the heat due to energy loss in the transformer or the choke coil to be removed from the circulatory loop of the internal coolant, such as oil, for example, by heat exchangers or heat pumps which are connected either in parallel or in series with the normal cooling system. The system can be turned off or by-passed. The transformer per se represents at least part of a required heat accumulator.

In accordance with other features of the device of the invention, the parts of the normal cooling system, such as radiators, oil-air or oil-water coolers, are throttled or restricted individually or in combination by manifolds or at collector pipes at several or only at a single location, depending upon the difference between the actual and the nominal or set-point value of the oil-temperature under the cover. That value is dependent upon the transformer loading or is alternately independent of or dependent upon ambient temperature. In this regard, permissible oil temperatures in the cover are provided from the consideration that, in accordance with German engineering norms DIN 57536, issue of March 1977, below a heat-point temperature of 80° C. at the insulation, the reduction in the operational or normal useful life thereof is negligibly small.

In accordance with more specific features of the invention, there is provided a device for performing the method of utilizing heat due to energy loss in a coil device having an interior containing an insulated coil winding cooled by a liquid cooling system, comprising means for throttling the liquid cooling system in accordance with an adjusted difference between the temperature of the interior liquid coolant taken at a location under a casing cover of the coil evice, and a maximum permissible temperature for a normal useful life the coil-winding insulation so that the temperature of the inner coolant is lower when the coil device is under full load than when it is under partial load.

In accordance with another feature of the invention, the liquid-cooled coil device serves per se as heat accumulator for utilizing the heat due to energy loss thereof.

In accordance with a further feature of the invention, there are provided means for throttling parts of the normal cooling system individually at least at one location.

In accordance with a concomitant feature of the invention, there are provided means for throttling parts of the normal cooling system collectively through manifolds at least at one location.

The device according to the invention is very advantageous because it enhances efficiency and economy by the utilization of the heat due to energy loss in transformers considerably by raising the temperature of the inner coolant to values which actually do not yet cause a reduction of the operational or useful life, because the actual temperature difference occurring at partial load between the transformer winding and the internal coolant is controlled. Therefore, an increase in the coolant temperature is possible during partial load conditions without any reduction thereby in the operational or useful life of the insulating materials which are employed.

Other features which are considered as characteristic for the invention are set forth in the appended claims.

Although the invention is illustrated and described herein as embodied in a device and method for utilization of heat due to losses in transformers or choke coils which are internally cooled by a liquid, it is nevertheless not intended to be limited to the details shown, since various modifications and structural changes may be made therein without departing from the spirit of the invention and within the scope and range of equivalents of the claims.

BRIEF DESCRIPTION OF THE DRAWING

The construction and method of operation of the invention, however, together with additional objects and advantages thereof will be best understood from the following description of specific embodiments when read in connection with the accompanying single FIGURE of the drawing which is a diagrammatic and schematic view of a device according to the invention for performing the method of utilizing heat due to energy loss in a coil device, namely a transformer, in accordance with the invention.

Referring now to the drawing, there is shown a diagrammatically represented conventional transformer tank 1 provided at the wider side thereof with a cooling system 2 for normal or conventional cooling of the inner coolant-oil which becomes heated by the winding and iron losses in the interior of the transformer. The cooling system is formed, in a conventional manner, of non-illustrated radiators, oil-coolers with forced air cooling or oil-water coolers. A collecting pipe or manifold 3 connects the oil return line of several parts of the cooling system 2 and leads to a throttle or restrictor represented as a valve 5. The valve 5 is automatically adjusted by a temperature sensor 4 in the oil within the cover of the tank 1 and by a temperature control or regulator 13 in accordance with a given temperature set point, so that the temperature values for the oil in the cover set by a set-point generator are maintained. The temperature set-point depends mainly upon the loading of the transformer, and is, furthermore, variable in accordance with the heat requirement for heating purposes or for heating water suitable for consumption.

An oil-water heat exchanger 7 is connected to the transformer tank 1 parallel to the normal cooling system 2, via a valve 11 in an oil forward-flow line, and via a valve 12 in an oil return line, the oil circulation being urged by a pump 6. The water heated in the heat exchanger 7 is forced by a pump 8 into a water forward-flow line 9. When the heat due to energy loss is utilized for heating purposes, the cooled water returns in a closed cycle through a water return line 10 to the heat exchanger 7. If the heat due to energy loss is utilized for heating water which is consumed, there is no closed water circulation or circulatory loop. In such a case, the pipe 10 serves to supply fresh water, and discharge of heated water from the heat exchanger 7 occurs through the pipe 9.

If less heat is removed at the water side of the oil-water heat exchanger 7 than it is capable of delivering based upon the design or construction thereof and the heat due to energy loss supplied by the transformer, the valve 5 in the oil return line of the normal transformer cooling system 2 is opened to a greater or lesser extent by the temperature sensor 4 in the oil within the cover of the tank 1 and the temperature controller 13, and the surplus heat is thereby removed via the normal cooling system 2. Therefore, no additional temperature regulating device is required in the water circulatory loop.

By means of a process computer, for example, the temperature regulator 13, by a suitable predetermination of the set point of the oil-temperature in the cover, can take into account the condition that the heat requirement and, accordingly, the temperature of the forward-flowing water entering the heating installation should increase with decreasing ambient temperature in order to maintain a constant room temperature.

For all cases wherein the forward-flow line temperature of the coolant is inadequately high for a particular application, the heat due to energy loss of the transformer can also be extracted from the coolant by the evaporator of a heat pump. Due to the introduction or use of a heat pump, the heat due to energy loss of the transformer is raised to a higher temperature level in these cases.

There is claimed:

1. Method of utilizing heat due to energy loss in a coil device having an interior containing an insulated coil winding cooled by a liquid cooling system, which comprises throttling the cooling system in accordance with an adjusted difference between the temperature of the interior liquid coolant taken at a location under a casing cover of the coil device, and a maximum permissible temperature for a normal useful life of the coil-winding insulation and so that the temperature of the inner coolant is lower when the coil device is under full load than when it is under partial load.

2. Method according to claim 1 which comprises adjusting the temperature of the interior liquid coolant in dependence upon the loading on the coil device, the temperature decreasing with increasing loading on the coil device.

3. Method according to claim 1 which comprises adjusting the temperature of the interior liquid coolant independently of ambient temperature.

4. Method according to claim 1 which comprises adjusting the temperature of the interior liquid coolant, with consideration to various heating requirements, in dependence upon ambient temperature.

5. Method according to claim 1 which comprises adjusting the difference between the temperature of the interior liquid coolant and the permissible temperature for the insulation independently of a quantity of heat used for heating purposes by intermittently operating the cooling system of the coil device.

6. Method according to claim 1 wherein the temperature of the interior coolant at the location under the casing cover of the coil device is at most substantially 57° C. at full load and ambient temperatures of +2° C. and, at half load, at most substantially 72° C. independently of ambient temperature.

7. Device for performing a method of utilizing heat due to energy loss in a coil device having an interior containing an insulated coil winding cooled by a liquid cooling system, comprising means for throttling the liquid cooling system in accordance with an adjusted difference between the temperature of the interior liquid coolant taken at a location under a casing cover of the coil device, and a maximum permissible temperature for a normal useful life of the coil-winding insulation and so that the temperature of the inner coolant is lower when the coil device is under full load than when it is under partial load.

8. Device according to claim 7 wherein the liquid-cooled coil device serves per se as heat accumulator for utilizing the heat due to energy loss thereof.

9. Device according to claim 7 including means for throttling parts of the normal cooling system individually at least at one location.

10. Device according to claim 7 including means for throttling parts of the normal cooling system collectively through manifolds at least at one location.

* * * * *